US005806268A

United States Patent [19]

Koller

[11] Patent Number: 5,806,268

[45] Date of Patent: Sep. 15, 1998

[54] BUILDING SKELETON OF PROFILED BARS

[76] Inventor: Ernst Koller, Paradiesstrasse 64, CH-4102 Binningen, Switzerland

[21] Appl. No.: 763,248

[22] Filed: Dec. 10, 1996

[30] Foreign Application Priority Data

Jan. 13, 1996 [DE] Germany ..... 196 01 065.9

[51] Int. Cl.[6] ..... E04H 12/00

[52] U.S. Cl. ..... 52/653.1; 52/731.2; 52/730.1; 52/730.4; 52/730.5; 52/720.1; 52/731.7; 52/93.1

[58] Field of Search ..... 52/731.2, 730.1, 52/730.4, 730.5, 720.1, 653.2, 716.5, 93.1, 731.7, 633, 641, 645, 647, 650.2

[56] References Cited

U.S. PATENT DOCUMENTS

| | | | |
|---|---|---|---|
| 3,143,165 | 8/1964 | Lewis et al. | 52/731.2 X |
| 3,894,766 | 7/1975 | Woodward | 52/93.1 X |
| 4,583,359 | 4/1986 | Staeger | 52/653.2 |
| 5,398,909 | 3/1995 | Sandwith | 52/731.2 X |
| 5,471,809 | 12/1995 | Frankel | 52/731.2 X |

*Primary Examiner*—Carl D. Friedman
*Assistant Examiner*—W. Glenn Edwards
*Attorney, Agent, or Firm*—Ostrolenk, Faber, Gerb & Soffen, LLP

[57] ABSTRACT

A building skeleton comprising profiled bars of rectangular profile and/or of I-profile. The rectangular bars have undercut grooves of the same size and cross section that extend longitudinally along each of the sides of the rectangular bars. The I-bars have such grooves on the outward sides of the transverse parts of the I-bars. Intermediate elements are receivable in the grooves for connecting two bars having grooves laid one over the other or two bars arranged one after the other along a path. In one embodiment, smaller cross section rectangular bars are telescopically insertable into hollow, larger cross section rectangular bars. The height of a side of the rectangular bar may be the same as the height of an I-shaped bar between its transverse parts or their respective heights may be different, which enables nesting of a smaller size rectangular bar or a smaller sized I-bar between the transverse parts of a larger size I-bar.

12 Claims, 4 Drawing Sheets

H2.2
10
6
4.2
10
H2.2
10
10
2.2
6
24
10
12
2.2
10
H2.2

BUILDING SKELETON OF PROFILED BARS

BACKGROUND AND SUMMARY OF THE INVENTION

The present invention relates to a building skeleton comprised of profiled bars and relates to their shaping and their interconnection.

SUMMARY OF THE INVENTION

The object of the invention is to develop a building skeleton so that it requires merely a few different profiled bars and does not require any special tools for assembling and disassembling the building skeleton.

The building skeleton of the invention comprises profiled bars of rectangular cross sectional profile and/or of I-cross sectional profile. The profiled bars have grooves of the same size and cross section that extend longitudinally along each of the sides of the rectangular bars or on the outward sides of the transverse parts at the ends of the webs of the I-shaped bars.

Intermediate elements are receivable in the grooves for connecting two bars whose grooves are laid one over the other defining an enclosed space between the grooves or for connecting bars arranged one after the other along a path.

In one embodiment, smaller cross section rectangular bars are telescopically insertable into hollow larger cross section rectangular bars.

The height of one side of the rectangular bar may be the same as the height of an I-shaped bar between the transverse parts thereof. Alternatively, the respective heights may be different, which enables nesting of a smaller size rectangular bar or a smaller sized I-bar between the transverse parts of the larger size I-profiled bar.

Objects and features of the invention are described below with reference to the drawings showing preferred embodiments.

DESCRIPTION OF PREFERRED EMBODIMENTS

Figure 1:
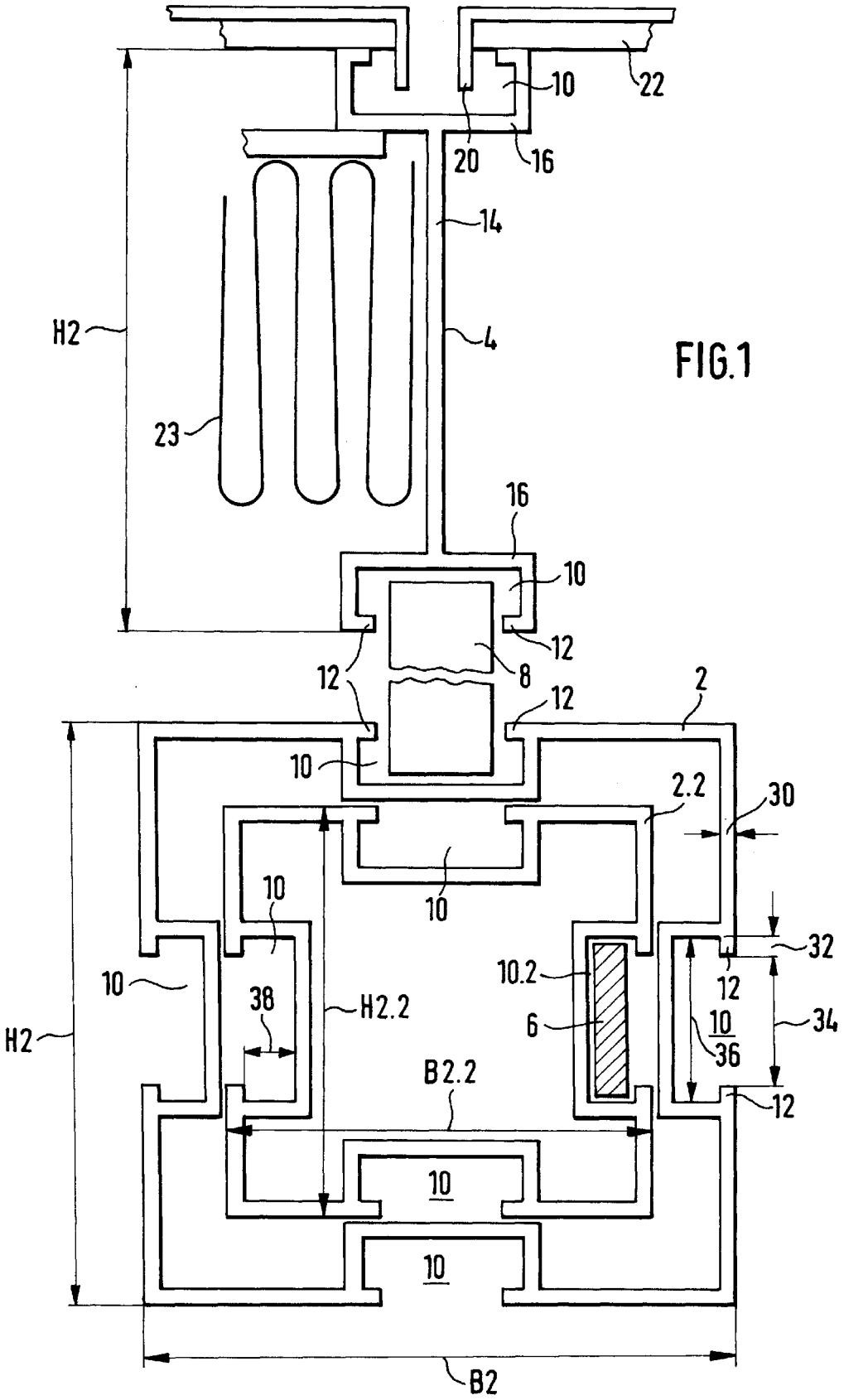
FIG. 1 is an end plan view of a part of a building skeleton in accordance with the invention.

A building skeleton in accordance with the invention is essentially comprised of only rectangular profiled bars 2, profiled I-bars 4 which are adapted in size and shape to the bars 2, and intermediate elements in the form of connecting elements 6 and wall elements 8 disposed between and connecting adjacent profiled bars.

The height H2 of the rectangular profiled bars 2 is preferably the same as their width B2, so that in one embodiment, they are essentially square in cross section. The I-profiled bars 4 have a height H2 which is the same as the height H2 or the width B2 of the rectangular profiled bars 2. The rectangular profiled bars 2 and the I-profiled bars 4 have only flat surfaces. At the center of at least one side and preferably of all of its outer sides, each rectangular bar has a longitudinal groove 10 that extends in the longitudinal direction and is undercut as seen in cross-sectional view. The outwardly facing sides of the transverse parts of the I-profiled bars also have respective grooves 10 formed in them. All of the longitudinal grooves 10 have the same cross-sectional shape and size. The longitudinal grooves 10 of the I-profiled bar 4 are alignable with the longitudinal grooves 10 of the rectangular profiled bar 2 when they are placed against each other in longitudinal direction with the grooves 10 of the adjacent bars above one another and opening onto one another, or the grooves 10 are arranged end-to-end with respect to each other, with one groove leading into the next one with successive bars along a path. The longitudinal grooves 10 are "undercut", which in this case means that they have a smaller or narrower entry opening on their outer side than their width inside the depth of the groove. As a result, connecting elements 6 inserted into the grooves rest against opposing projections 12 of the longitudinal grooves 10 from the inside of the groove to the outside of the groove and the connecting elements can thus be anchored in the longitudinal grooves 10. The longitudinal grooves 10 preferably have the T-shaped cross-sectional shape shown in FIG. 1 with a rectangular cross section below the rib-like projections 12, which are also rectangular in cross section. Other cross-sectional shapes of the groove are also possible, for instance, an outwardly narrowing trapezoidal shape, a dovetail shape or some other shape which is larger or wider inside the groove than at the outside of the groove.

The I-profiled bar 4 is comprised of a single web 14 with flat, smooth side surfaces and without lateral projection. The bar 4 includes transverse parts at the ends of the web 14. Longitudinal grooves 10 are formed symmetrically over the web 4 on the outer sides of the web ends.

The rectangular profiled bar 2 can be a solid section. But, as shown in FIG. 1, the bar 2 is preferably a hollow section.

Each transverse part or web 16 at the edge of the web of the I-shaped bar comprises a wall in which a longitudinal groove 10 is formed. That wall preferably has the same thickness as the rectangular profiled bar 2 in the region thereof forming its grooves 10. In this way, the wall of the longitudinal groove 10 of an I-profiled bar 4 coincides at the front with the wall of a rectangular profiled bar 2 when these two profiled bars 2 and 4 are so placed end-to-end against each other that the longitudinal groove 10 of the I-profiled bar 4 is aligned with the longitudinal groove 10 of the rectangular profiled bar 2.

The two shapes of the profiled bars 2 and 4 are preferably comprised of aluminum but may, however, also be comprised of another metal, a plastic, reinforced plastic, or wood.

Longitudinal grooves 10 lying on the outer side of a building can serve as water discharge spouts for water of condensation or rain water and/or to receive end pieces 20 of outer wall plates 22 of the building. Wall plates 22 can be fastened in outer longitudinal grooves 10 by fastening means (not shown), which can engage behind the projections 12 of the groove 10 or can be screwed into a fastening element present in the longitudinal groove 10, or can be otherwise attached or screwed into the bottom of the longitudinal groove 10. Insulating material 23 can also be arranged in the hollow spaces.

In a particular embodiment of the invention, two different cross-sectional sizes of rectangular profiled bars 2 and/or I-profiled bars 4 are provided. Such additional rectangular profiled bars of different cross-sectional size and I-profiled bars of different cross-sectional size are also adapted in size and shape to each other so that their longitudinal grooves 10 are aligned when they are arranged adjoining each other end-to-end. Preferably, all of the profiled bars of various sizes and shapes have grooves 10 of the same cross sectional size and shape.

FIG. 1 shows one such additional rectangular profiled bar 2.2. As seen in cross section, that bar 2.2 is identically developed to the rectangular profiled bar 2 described above. But it is so much smaller in cross section that, as shown in FIG. 1, it can be inserted telescopically with a sliding seat into the hollow space in the rectangular profiled bar 2. The height H 2.2 of the smaller rectangular profiled bar 2.2 is equal to its width B 2.2. The longitudinal grooves 10 of the different size rectangular profiled bars 2 and 2.2 all have the same cross-sectional shape and the same cross-sectional size.

Use of two or more rectangular profiled bars 2 and 2.2, which can be inserted telescopically one within the other in the longitudinal direction of the bar, can take into account the weight loads which decrease with increasing height of the building. Furthermore, building elements, for instance, beams, girders and roofs, can be placed or supported on the end surface of the rectangular profiled bars 2 of larger cross section which extend in the transverse direction of the profiled bar over the rectangular profiled bars 2.2 of smaller cross section.

Figure 2:
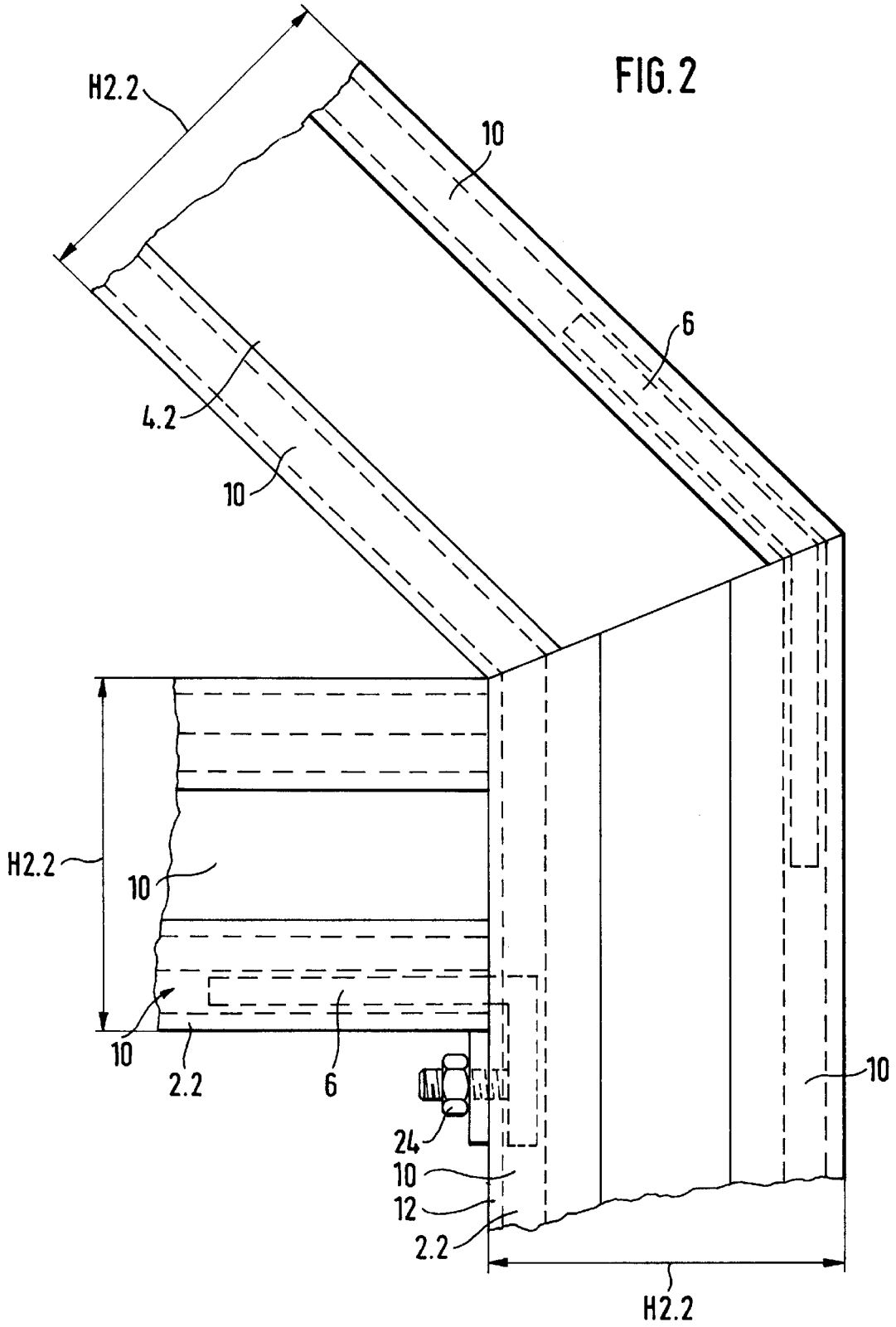
FIG. 2 is a side view of a part of a building skeleton in accordance with the invention.

FIG. 2 shows a rectangular profiled bar 2.2 of smaller cross section, which may be the rectangular profiled bar 2.2 of FIG. 1, used as a building pillar or column. A rectangular profiled bar 2.2 of the same size and shape in cross section as the pillar bar 2.2 is placed at an angle to and anchored by a connecting element 6 and by a tightening screw device 24 to the pillar bar 2.2. The connecting element 6 is bent off at a right angle. One arm of element 6 extends into the longitudinal groove of the vertically arranged rectangular profiled bar 2.2, while its other arm extends into the longitudinal groove 10 of the horizontal rectangular profiled bar 2.2. The tightening screw device 24 clamps the vertical arm of the connecting element 6 against the projections 12 of the longitudinal groove 10 of the vertical rectangular profiled bar 2.2, into which groove the vertical arm of the connecting element 6 is inserted. An identical tightening screw device 24 can also fasten the horizontal arm of the connecting element 6 in the longitudinal groove 10 of the horizontal rectangular profiled bar 2.2.

An I-profiled bar 4.2 serves as a rafter. With its oblique cut off end, it is placed against the upper end of the vertical rectangular profiled bar 10.2 of FIG. 2 and is anchored to it by another fastening element 6. The latter element 6 has arms which engage into the longitudinal grooves 10 of these two profiled bars 2.2 and 4.2. The height H2.2 of the I-profiled bar 4.2 of FIG. 2 is equal to the height H2.2 of the rectangular profiled bar 2.2 of smaller cross section. The cross-sectional shape and cross-sectional size of the four longitudinal grooves 10 of the I-profiled bar 4.2, each of which is arranged in the transverse center of the respective side of the bar 4.2, are the same as for all other profiled bars 2, 4 and 2.2. In this way, all longitudinal grooves 10 are alignable with each other when they are arranged end-against-end with respect to each other. The correspondingly smaller height H2.2 of the profiled bars 2.2 and 4.2 are present in FIG. 2.

The height H2 or H2.2 of the rectangular profiled bars 2 and of the I-profiled bars 4 and 4.2 is preferably 80, 100, 120, 140 or 160 mm. The thickness of the material in the case of all profiled bars 2, 2.2, 4, 4.2, 4.4 is preferably the same and, in the case of metal, is preferably between 2 mm and 6 mm. The projections 12 have a thickness 30 which is preferably equal to the thickness of the material, a height 32 of between 2 mm and 6 mm, a rectangular cross-sectional shape, and, in the case of each longitudinal groove 10, a distance 34 apart of between 20 mm and 50 mm. Below the projections 12, the longitudinal grooves 10 have a width 36 which, symmetric to the projections 12, is at least 2 mm greater than the distance between the ends of the projections 12, and the grooves have a rectangular cross-sectional shape with a depth 38 of groove of between 4 mm and 12 mm below the projections 12.

Figure 3:
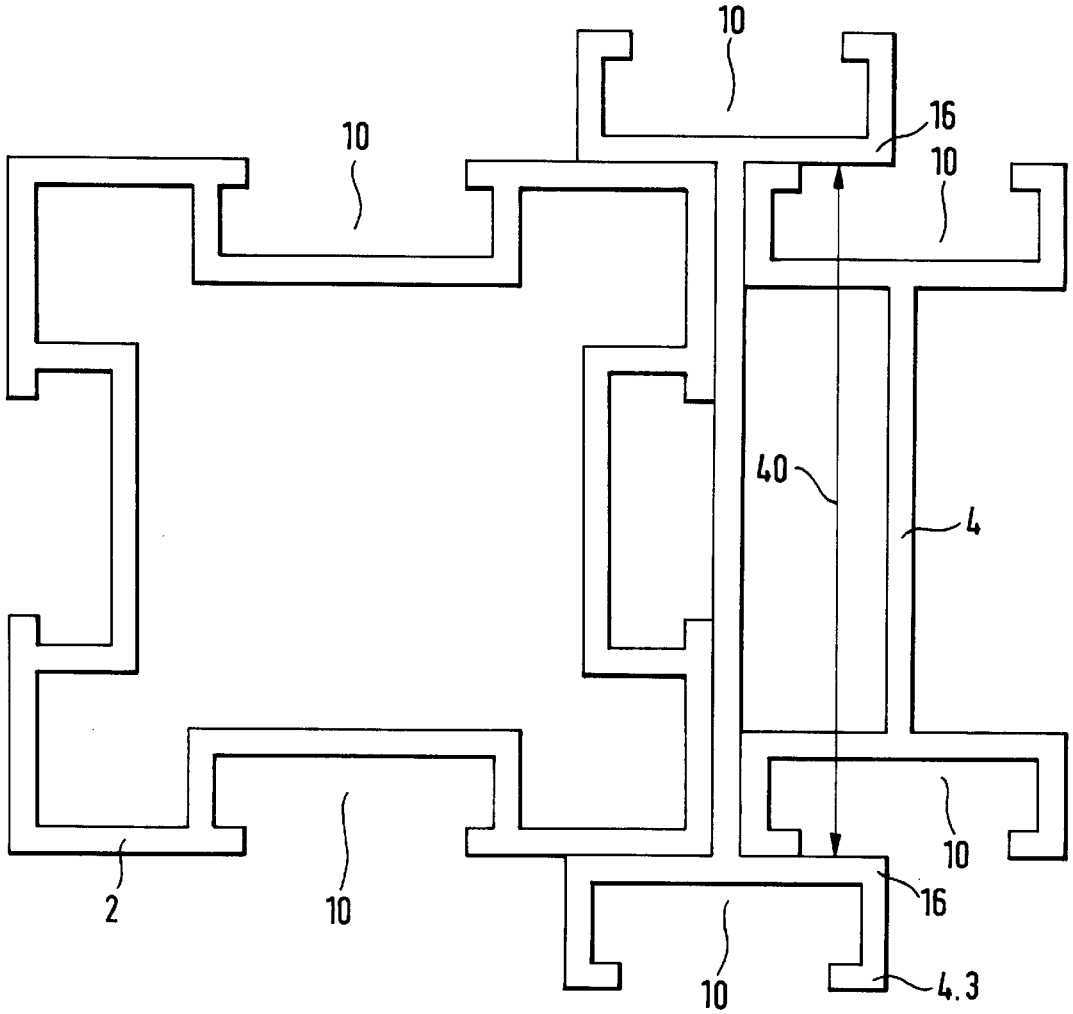
FIG. 3 is an end plan view of a further arrangement of profiled bars in accordance with the invention.

FIG. 3 shows an arrangement with a rectangular profiled bar 2, an I-profiled bar 4 of the same height, and a next-larger I-profiled bar 4.3, between the transverse parts 16 of which the other two profiled bars 2 and 4 can be inserted laterally.

The longitudinal grooves 10 preferably have the rectangular cross-sectional shape shown in the drawings. However, other cross-sectional shapes such as dovetail shape or trapezoidal shape are also possible.

Figure 4:
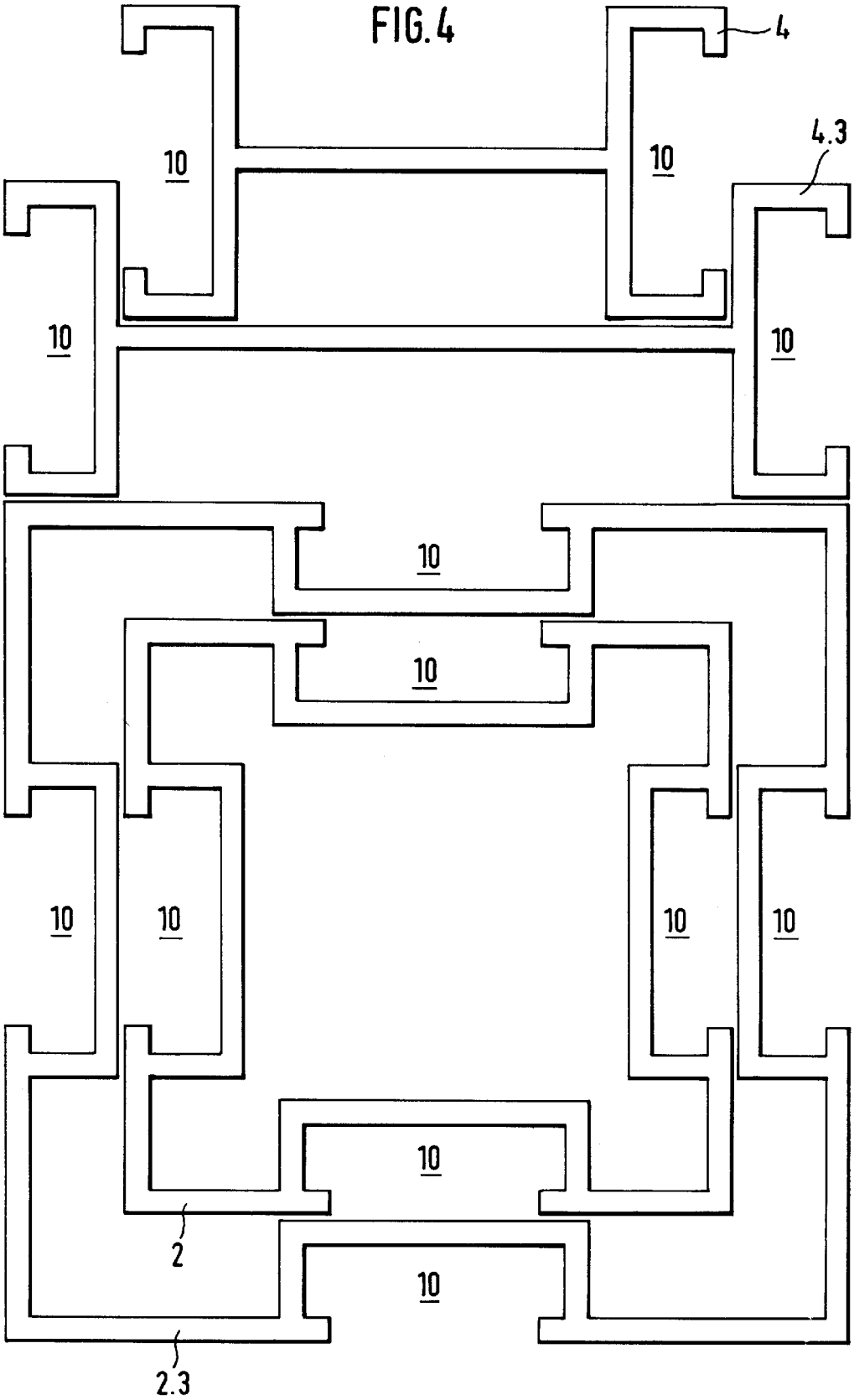
FIG. 4 is an end plan view of another variant.

FIG. 4 shows how the rectangular profiled bars 2 and 2.3 of different sizes, but which are developed with the same shape and size grooves, as well as I-profiled bars developed correspondingly with identical shapes and identical grooves harmonize with and may be adapted to each other.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An assembly of bars for being assembled into a building skeleton, the assembly being comprised of at least one first profiled bar having a rectangular cross-sectional profile and at least one second profiled bar having an I-shaped profile, the first and second bars being disposed adjacent, one another and an intermediate element disposable between the adjacent at least one first and at least one second profiled bars;

each of the first and second profiled bars, in cross section, having at least one respective longitudinal groove extending longitudinally along the bar, and the respective grooves of the bars being of the same cross-sectional size and shape;

each of the first rectangular bars having an outer side with one of the longitudinal grooves thereof located symmetrical to the transverse center;

each of the second I-shaped bars having a main web and having a transverse part extending transverse to the web of the I, the transverse part having a respective outward side thereof in which one of the longitudinal grooves is formed, symmetric to the center web joining the transverse parts of the I-shaped bar; and the longitudinal grooves having respective undercut cross-sectional profiles shaped for receiving the intermediate elements therein and the intermediate elements being securable in the longitudinal grooves.

2. The assembly for a building skeleton according to claim 1, wherein the longitudinal grooves of the adjacent first and second bars are so placed on the respective profiled bars that when the first and the second profiled bars are oriented with their respective grooves opening toward each other, a respective one of the intermediate elements is receivable in those two longitudinal grooves.

3. The assembly for a building skeleton according to claim 2, wherein each of the first rectangular bars has a plurality of the outer sides with a respective one of the grooves being defined in each outer side.

4. The assembly for a building skeleton according to claim 1, wherein each side of the first rectangular bar is of equal height.

5. The assembly for a building skeleton according to claim 1, wherein the first rectangular bars are hollow profiled bars along the longitudinal direction.

6. The assembly for a building skeleton according to claim 5, further comprising:

at least one third rectangular profiled bar having a cross section that is smaller than the cross section of the at least one first rectangular bar and being sized so as to be and being insertable telescopically and slidingly in the longitudinal direction into the at least one first profiled bar, wherein the cross sections of the first and the third bars are such that the interior of the first bar defines a seat for the third bar telescopically inserted therein; and the at least one third bar having at least one side with a longitudinal groove defined therein, and the longitudinal grooves in the sides of the at least one first profiled bar and the longitudinal grooves in the sides of the at least one third profiled bar have the same cross-sectional shape and cross-sectional size, whereby intermediate elements may be received therein.

7. The assembly for a building skeleton according to claim 3, wherein the at least one second I-shaped bar has a web that is the same height between the transverse parts thereof as one of the sides of the first rectangular profiled bar.

8. The assembly for a building skeleton according to claim 2, wherein the at least one second I-shaped bar has a web greater height between its transverse parts, and another of the second I-profiled bars or one of the sides of the first rectangular bars, for enabling the shorter height second I-shaped bar or the shorter height side first rectangular bar to be inserted laterally between the transverse parts of the first mentioned greater height I-profiled bar and into contact with the web of that I-profiled bar.

9. The assembly for a building skeleton according to claim 2, wherein each of the sides of the first rectangular profiled bar has a respective longitudinal groove therein located at the center of the width of the respective side, and all of the grooves being of the same cross-sectional shape and size.

10. The assembly for a building skeleton according to claim 3, wherein the first and second bars are arranged along a path one after the other with the longitudinal grooves thereof extending such that an intermediate element is installable in the longitudinal grooves of the two bars to extend along the longitudinal length of the intermediate element from one of the bars to the other bar along the path.

11. The assembly for a building skeleton according to claim 10, wherein the two adjacent profiled bars have ends that are angled off so that two of the bars arranged longitudinally one after the other along a path are oriented angled off with reference to each other; and one of the intermediate elements is correspondingly angled off and extends between the adjacent profiled bars.

12. An assembly of bars for being assembled into a building skeleton, the assembly being comprised of at least one first profiled bar having a rectangular cross-sectional profile and at least one second profiled bar having an I-shaped profile, the first and second bars being disposed adjacent, and an intermediate element disposable between the adjacent first and second profiled bars;

each of the first and second profiled bars, in cross section, having at least one respective longitudinal groove extending longitudinally along the bar, and the respective grooves of the bars being of the same cross-sectional size and shape;

each of the first rectangular bars having an outer side with one of the longitudinal grooves thereof located symmetrical to the transverse center;

each of the second I-shaped bars having main web and having a transverse part extending transverse to the web of the I, the transverse part having a respective outward side thereof in which one of the longitudinal grooves is formed, symmetric to the center web joining the transverse parts of the I-shaped bar; and the longitudinal grooves having respective undercut cross-sectional profiles shaped for receiving the intermediate elements therein and the intermediate elements being securable in the longitudinal grooves, the longitudinal grooves being so placed on the profiled bars that when two of the profiled bars are oriented with their respective grooves opening toward each other, a respective one of the intermediate elements may be received in those two longitudinal grooves;

wherein there are at least two of the second I-shaped bars, at least one of the second I-shaped bars having a web greater height between its transverse parts, and another of the second I-profiled bars or one of the sides of the first rectangular bar, for enabling the shorter height second I-shaped bar or the shorter height side first rectangular bar to be inserted laterally between the transverse parts of the first mentioned greater height I-profiled bar and into contact with the web of that I-profiled bar.

* * * * *